US005357650A

United States Patent [19]

Finley

[11] Patent Number: 5,357,650

[45] Date of Patent: Oct. 25, 1994

[54] CARPET WATER REMOVER

[76] Inventor: Bill G. Finley, P.O. Box 245, Searcy, Ark. 72143

[21] Appl. No.: 61,524

[22] Filed: May 17, 1993

[51] Int. Cl.[5] ..... A47L 11/29

[52] U.S. Cl. ..... 15/401; 15/415.1; 15/98

[58] Field of Search ..... 15/98, 142, 320–322, 15/415.1, 401

[56] References Cited

U.S. PATENT DOCUMENTS

| | | | |
|---|---|---|---|
| 2,572,142 | 10/1951 | Hartenbach | 15/321 |
| 3,736,619 | 6/1973 | Zamboni | 15/340.1 |
| 3,848,291 | 11/1974 | Morse | 15/322 |
| 3,992,747 | 11/1976 | Hufton | 15/321 |
| 4,107,808 | 8/1978 | Schroder | 15/142 |
| 4,139,922 | 2/1979 | Fitch | 15/321 |
| 4,619,218 | 4/1987 | Cyphert | 15/322 |
| 5,198,036 | 3/1993 | Sotolongo | 15/98 |

*Primary Examiner*—Timothy F. Simone
*Assistant Examiner*—Terrence R. Till
*Attorney, Agent, or Firm*—Stephen D. Carver

[57] ABSTRACT

A deflooding tool for vacuum removal of liquid such as water or the like from carpets, rugs or other floor coverings. Preferably the tool comprises a rigid, hollow generally cubicle vacuum chamber disposed substantially vertically with respect to the flooded carpet. The vacuum chamber includes a lower, open suction inlet for intaking liquids to be removed, and vacuum is supplied to the chamber by an elongated, rigid, tubular handle angularly coupled at one end to the top rear of the vacuum chamber. The remote end of the handle terminates in a connection to a conventional vacuum source. Wheels are rigidly mounted at the bottom rear of the vacuum chamber for facilitating the tool. A generally cylindrical, rigid heavy roller is mounted at the bottom front of the vacuum chamber for compressing the carpet, rug or other floor covering to liberate liquids to be captured through the vacuum inlet. Preferably the ratio of the wheel diameter to the roller diameter is 10:7. A rigid weight box is secured in spaced-apart relation relative to vacuum chamber and is vertically spaced-apart and substantially vertically aligned with the center of rotation of the roller. Because of the operative moments established by the centers of mass of the various portions of the tool, a mechanical advantage is experienced by the operator when the handle of the tool is either lifted or depressed during operation.

4 Claims, 4 Drawing Sheets

CARPET WATER REMOVER

BACKGROUND OF THE INVENTION

This invention relates broadly to carpet or rug cleaning apparatus. More particularly, my tool relates to vacuum systems for removing and capturing liquids such as water that has flooded a floor covering.

Flooding of disastrous proportions occurs repeatedly in several regions of the United States. For example, in the Spring of 1992 numerous cities and towns in Arkansas and Missouri were severely damaged by floods of various intensities. When water rises above the levels of homes or other buildings within the flood plain, damage to the contents of buildings is immediately experienced. One of the most vexatious forms of flood damage relates to the ruination of conventional carpets, pads or rugs employed in the building, dwelling or trailer that has been flooded. After flood waters recede the cleanup job is substantial. One of the major jobs involves the elimination of water residue, dirt and debris deposited upon and usually retained by the carpets, pads or rugs. At this time the usual procedure for recovery is to completely remove the flooded carpeting or floor covering to allow the floor area to thoroughly dry.

Afterwards, it is normal to entirely replace the carpet padding and rug or carpet surfaces throughout the house or dwelling. If complete removal is not effectuated along these lines, mildew will generally develop even after treating the carpet with known state-of-the-art carpet cleaning machines. Therefore many of the prior art methods employ a "mildewcide" to prevent the growth of mildew and fungus. However, secondary damage to the above floor structures of the home can occur. For example, evaporation and the associated high humidity can cause wall soaking resulting in mildew and fungus growth, wood swelling and general structural weakening.

A variety of carpet cleaning machines exist that employ vacuum suction. Conventional machines known to me employ a form of vacuum head which spray a cleansing detergent into the carpet or rug to be cleaned to effectuate a basic shampooing action simultaneously with application of vacuum. Dirt, debris and residue liberated from the carpet in this fashion is then sucked into the vacuum head and stored in a remote reservoir. The general principles involved are illustrated in U.S. Pat. No. 4,194,262 that sets forth subject matter that I previously co-invented.

Thus at the present time flooded carpeting is either completely removed and replaced, or "cleansed" with conventional vacuum extraction cleaning machines. The latter remedy is incomplete and results in subsequent mildewing of the carpet; the former remedy is time consuming and expensive. I have therefore developed a new system for quickly and reliably removing the majority of water from flooded carpets and the like. Importantly, the tool may be manually handled, and tool provides a weighted roller and adjacent suction source. The centers of mass of the components of the tool have been arranged so as to provide a mechanical advantage to the operator during manipulation of the tool.

SUMMARY OF THE INVENTION

The present invention comprises a manual tool for removing spilled liquids, flood water or the like from carpets, rugs or other floor coverings. Ideally my tool is employed to help recondition carpets or rugs that have been subjected to flooding and that now must be treated. With the use of my tool, stagnant water that has hitherto been difficult to remove from the pad is captured and displaced from the carpets. Afterwards, the carpets may be treated with conventional vacuum cleaning units and a high quality mildewcide to halt mildew and fungal action.

My tool includes a generally rectilinear hollow vacuum chamber of rigid, preferably metallic construction. The vacuum chamber, which is normally oriented substantially vertically with respect to the carpet or rug to be cleaned, includes a lower open suction region establishing an inlet for intaking liquid to be removed. An elongated, rigid, tubular handle is coupled in fluid flow communication to the vacuum chamber at one end, and its opposite end is coupled to a conventional vacuum source to establish vacuum chamber suction. A heavy, generally cylindrical roller is mounted for rotation at the bottom front of the vacuum chamber for compressing the carpet and pad or rug, thereby establishing a pool of liquid adjacent to the suction region for subsequent capture. Heavy duty plastic wheels are mounted on the opposite bottom side of the vacuum chamber to facilitate movement of the tool by operator manipulation of the handle.

Preferably a generally cubical weight box is secured in spaced-apart relation with respect to the top front of the vacuum chamber. A variable amount of weight may be selectively added to the weight box to increase the compression effects of the roller assembly. Preferably the weight's center of mass is spaced horizontally from the vacuum chamber, and vertically aligned above and in substantial alignment with the center of mass of the heavy roller below. The wheels disposed opposite the roller at the bottom of the vacuum chamber enables rolling of the device in an opposite direction.

In operation, the tool is first carried to the job site, and weights are added to the weight box to facilitate floor covering compression. The tubular handle is then connected to a vacuum source. The tool is manipulated manually by a human operator who grasps the handle. To capture liquids, the operator lifts the handle and draws the tool backwardly, toward him. Water liberated from the carpet by the compression of the weighted roller is forced into proximity of the vacuum chamber suction inlet and is drawn up through the vacuum chamber and out through the handle to a conventional vacuum recovery unit. The operator may then press down on the handle, transferring weight of the device to the wheels to push the unit forward to repeat the aforementioned compression process. Because of the locations of the centers of mass of my device the operator experiences the benefit of a mechanical advantage, in that the manipulative force required to operate the handle is reduced in response to the moment arms developed by the centers of mass of the operative parts over the relevant pivot points.

Thus a broad object of my invention is to provide a reliable and dependable, manually operable tool for helping to restore carpets, pads, rugs or other floor coverings after flooding.

More particularly, it is an object of the present invention to provide a manually operated vacuum device for removing flood water from carpets or the like.

A basic object is to provide a reliable deflooding tool.

Yet another object of the present invention is to provide a manual system for treating carpets by removing flood water therefrom to facilitate the subsequent vacuum extraction cleaning process and to promote the effectiveness of mildewcides.

Yet another object of my invention is to provide a rugged and dependable one man tool of the character described that may easily be transported by the tradesman to aid in the preparation of flooded carpet and floor covering surfaces prior to vacuum extraction cleaning thereof.

Yet another object of my deflooding tool is to provide a manual system of the character described that demands minimum energy input on the part of the manual operator.

A related object of the present invention is to provide a tool of the character described that provides the operator with a mechanical advantage while manipulating the tool.

A still further object of the present invention is to provide a liquid or water removal system for carpets and the like that obviates the need to completely replace carpets during the process of reconditioning a flooded home or dwelling.

These and other objects and advantages of the present inventions, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout to indicate like parts in the various views.

DETAILED DESCRIPTION OF THE DRAWINGS

Figure 1:
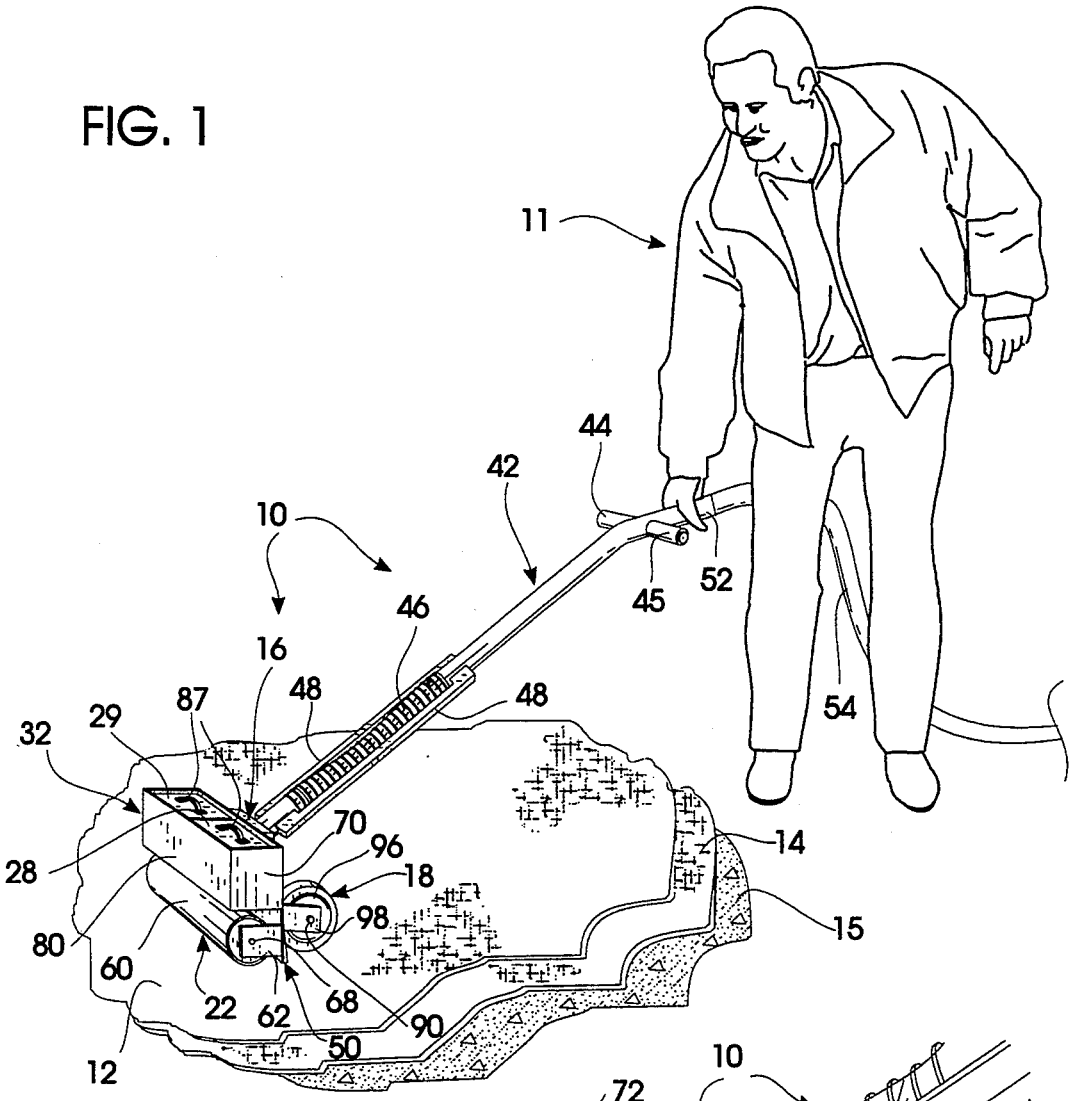
FIG. 1 is a pictorial environmental view illustrating the preferred embodiment of my carpet water removal tool deployed upon a flooded carpet.
Figure 2:
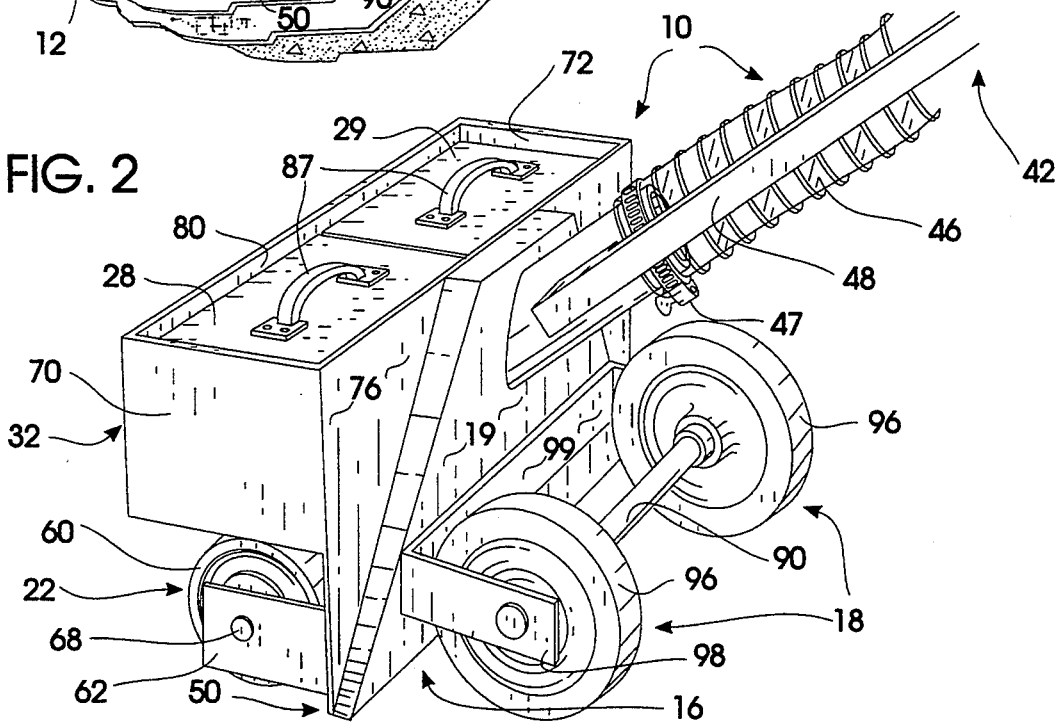
FIG. 2 is rear, partially fragmented isometric side view of the head of my tool.
Figure 8:
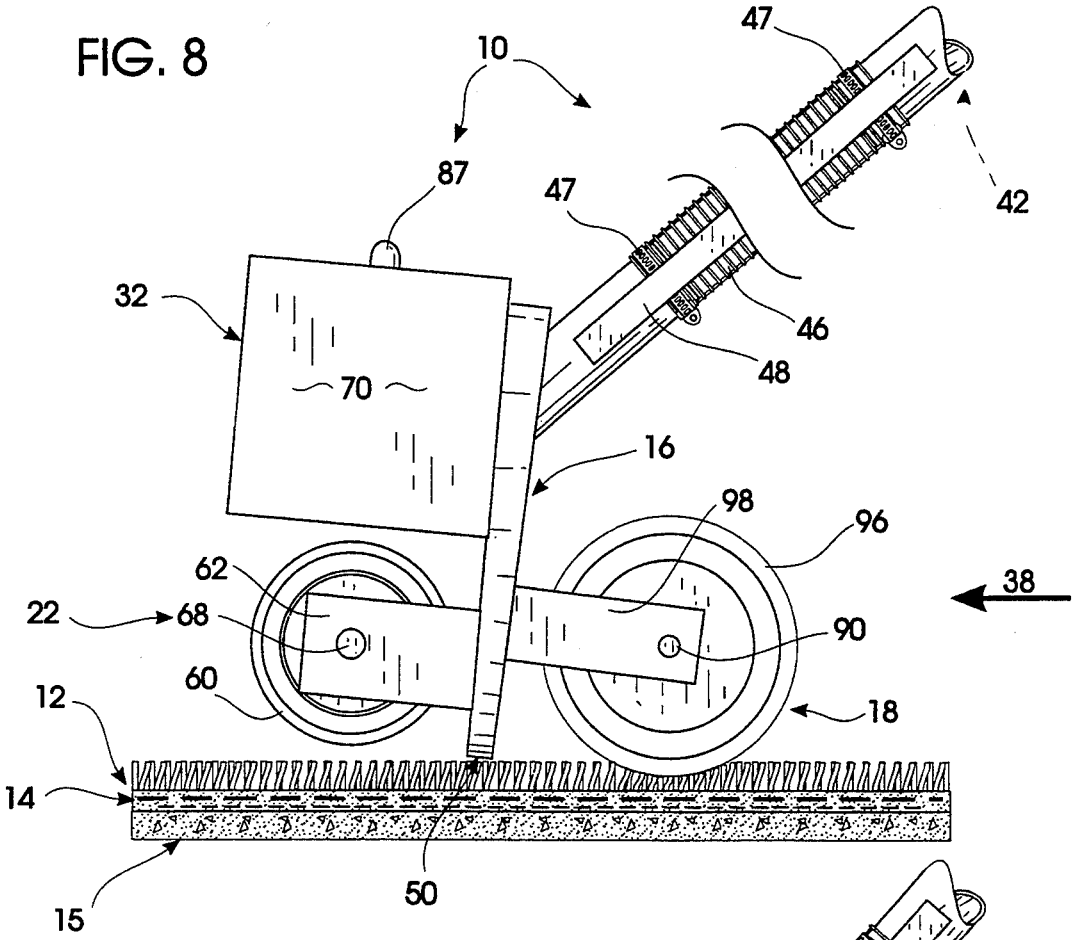
FIG. 8 is an enlarged fragmentary side elevational view of my tool deployed in the return stroke portion of its operative cycle; and, FIG. 9 is an enlarged, fragmentary side elevational view of my tool deployed in the water capturing position.
Figure 9:
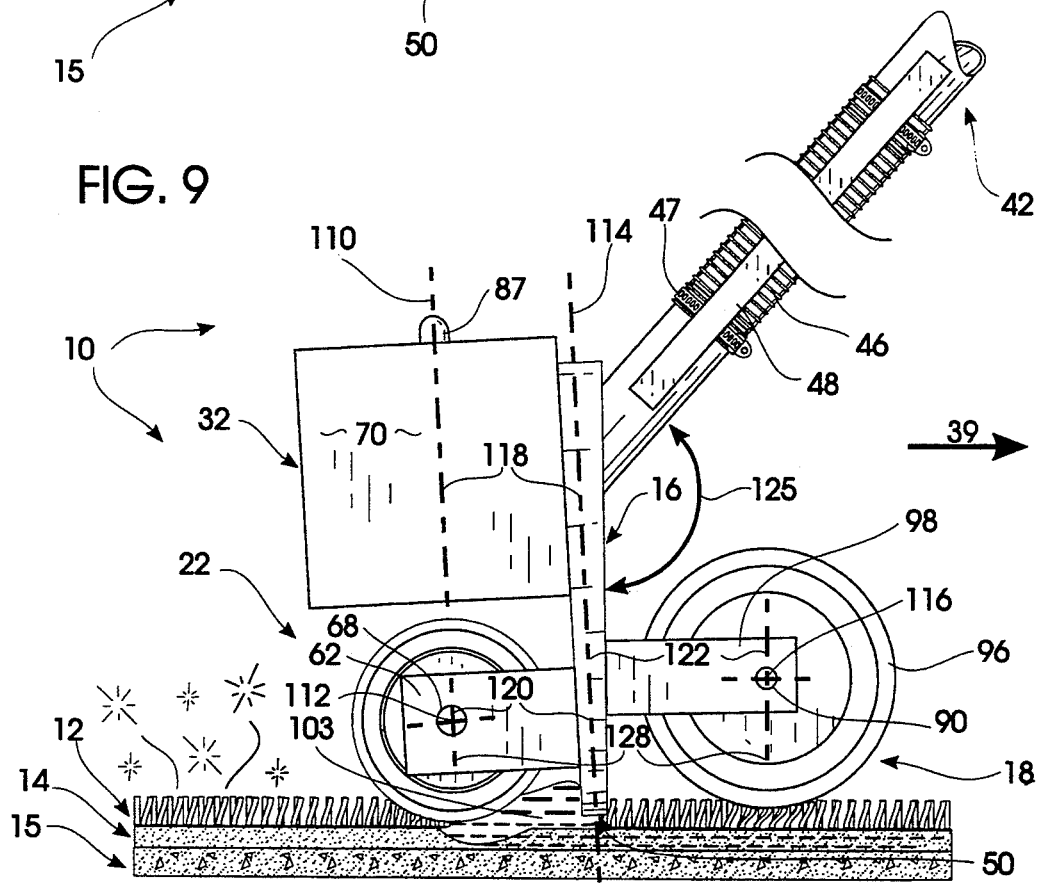

With initial reference now to FIGS. 1 and 2, my water removal tool has been generally designated by the reference numeral 10. In FIGS. 1, 8 and 9, tool 10 is deployed upon a carpet 12 that has been subjected to flood damage. The tool 10 is intended to be manually manipulated by an operator 11. In most applications a conventional carpet pad 14 is disposed between carpet 12 and the lower wooden or concrete floor 15. Tool 10 includes a generally rectilinear vacuum chamber 16 disposed substantially perpendicularly with respect to the lower carpet surface 12. A pair of spaced-apart heavy duty plastic wheel assemblies, generally designated by the reference numeral 18, are secured on opposite bottom sides of the rear surface 19 of the vacuum chamber 16. A generally cylindrical roller designated by the reference numeral 22 is operationally disposed at the bottom front of the vacuum chamber 16. Tool 10 is weighted by a pair of removable lead weights 28, 29 that are preferably disposed within a generally parallelepiped weight box, designated broadly by the reference numeral 32. The complete tool weighs between thirty and fifty pounds unweighted, depending upon size. Preferably weights 28 and 29 add between eighty and one hundred and sixty pounds of weight.

Cyclical manual movement of the tool 10 in the directions designated by arrows 38, 39 (FIGS. 8 and 9) is accomplished by manual manipulation of an elongated, rigid handle 42 that may be controlled with handle bars 44 and 45 by the operator 11. Handle 42 is of rigid, tubular construction and terminates in fluid flow communication with the interior of vacuum chamber 16. The handle preferably further comprises an intermediate translucent section 46. The translucent portion allows observation of liquid suctioned from the floor covering 12, 14 to aid in determining the effectiveness and thoroughness of the procedure. The translucent section 46 is preferably constructed from clear flexible tubing secured to the handle by aviation or radiator clamps 47. A pair of rigid reinforcement members 48 are disposed parallel to the handle 42, spanning the translucent portion 46.

Figure 6:
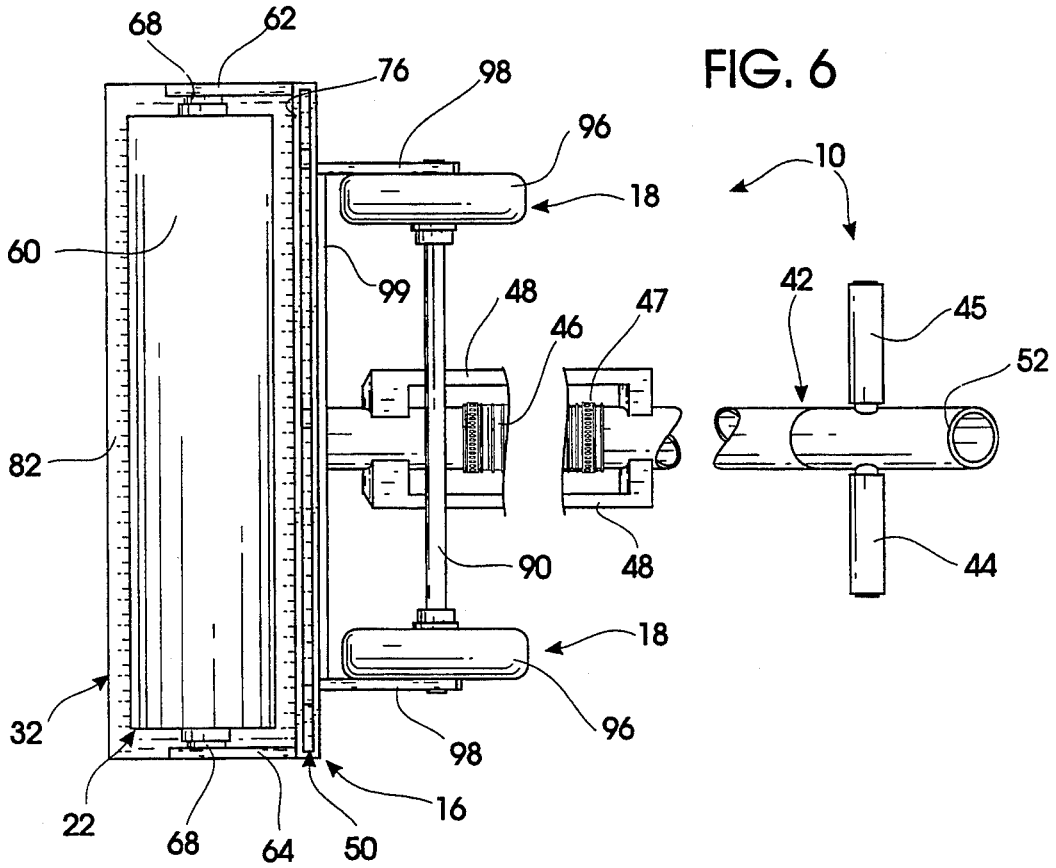
FIG. 6 is a fragmentary bottom plan view of the preferred tool.

As best viewed in FIG. 6, the vacuum chamber 16 includes a lower, substantially transverse open suction inlet generally designated by the reference numeral 50. Vacuum is inputted through a conventional source to handle end portion 52 via a conventional tube 54 (FIG. 1). Vacuum is thus supplied to the interior of the vacuum chamber and the suction inlet 50 will thus draw water or other debris upwardly into the vacuum chamber 16 from that region of the carpet in immediate proximity to inlet 50. Water and dirt is ultimately drawn out through handle 42 and hose 54. Recovered debris and dirt may be captured through a variety of known conventional systems, such as the system described in detail in my previously mentioned patent.

Figure 3:
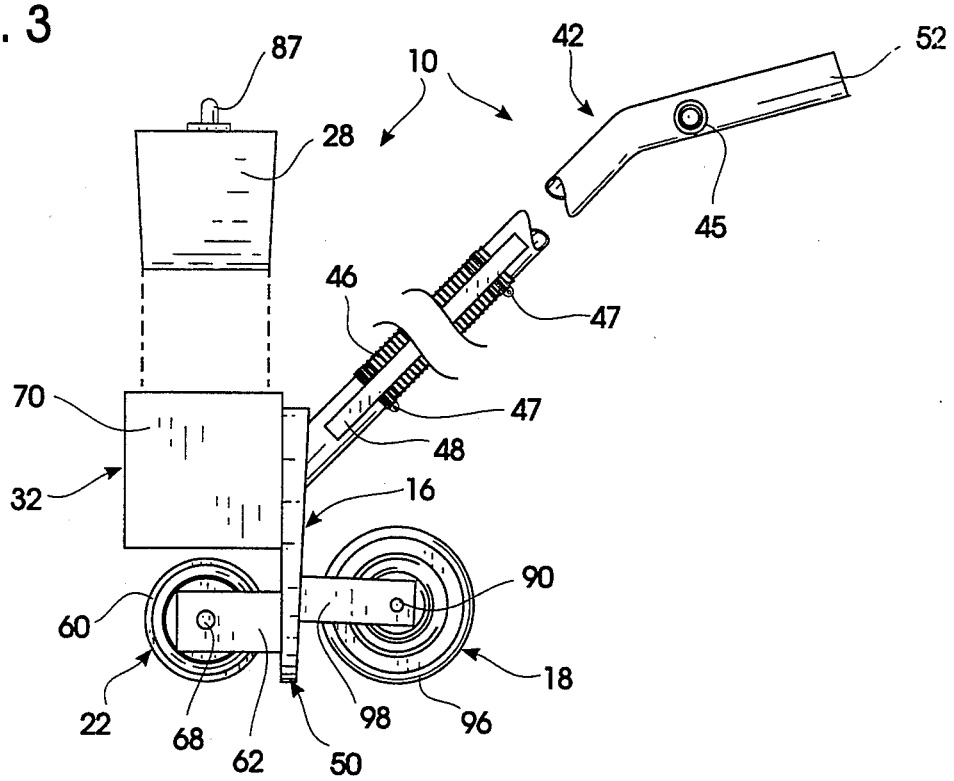
FIG. 3 is a fragmentary side elevational view of the preferred tool.
Figure 4:
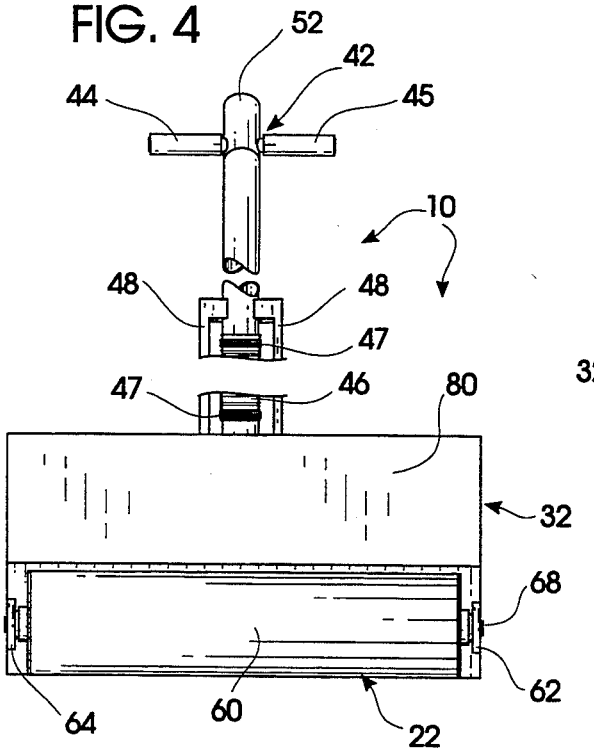
FIG. 4 is a fragmentary front elevational view of the preferred tool.

The cylindrical roller system 22 includes a generally cylindrical, metallic, relatively heavy roller 60. It is journalled for rotation between tabs 62, 64 that project outwardly from the front of the vacuum chamber 16. A conventional axle 68 rotatably secures the roller 60. The weight box 32 is of generally rectangular dimensions, including a pair of sides 70, 72 which project perpendicularly outwardly from a rear mounting plate 76. Sides 70, 72 are rigidly secured to a front plate 80 and an internal floor 82. Each of the tapered generally parallelepiped weights 28, 29, may be conveniently placed within the weight box by manipulation of handles 87 (FIG. 3). It will be appreciated from an inspection of the Figures that the center of mass of weight box 32 is thus horizontally spaced forward of the vacuum chamber 16. The center of mass is also substantially vertically aligned with the center of rotation of roller 60 established by pins 68. Thus the weight box 32 will tend to maintain the tool 10 in the configuration illustrated in FIG. 9. In other words, a lifting moment force is experienced by handle 42 and the tool is stable in the work position.

Figure 5:
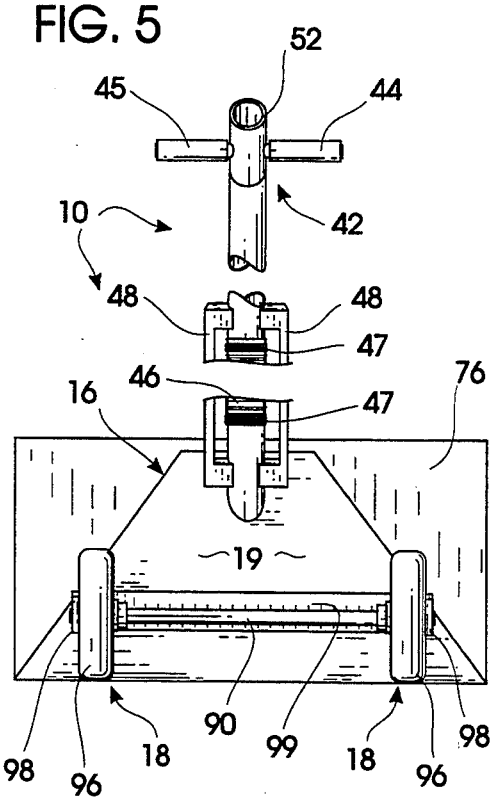
FIG. 5 is a fragmentary rear elevational view of the preferred tool.
Figure 7:
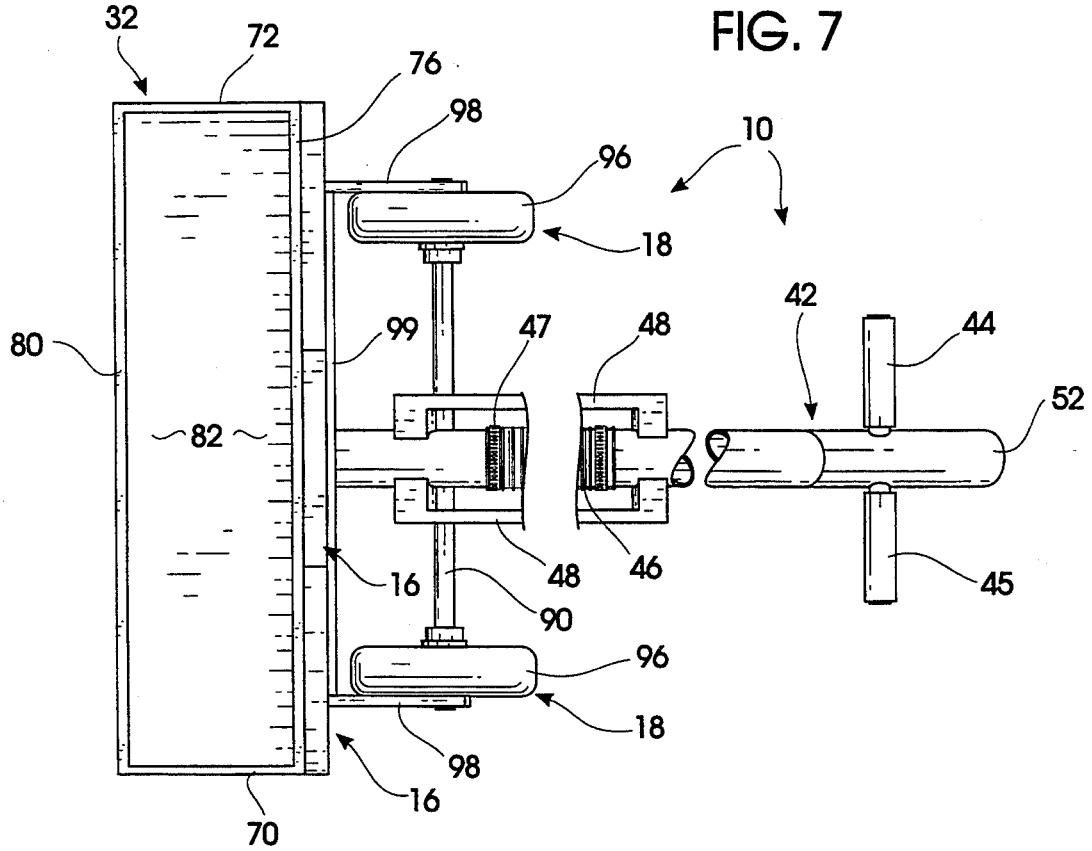
FIG. 7 is a fragmentary top plan view of the preferred tool.

With preliminary reference now directed to FIGS. 5 through 7, the wheel assemblies 18 are mounted at opposite, bottom sides of the rear surface 19 of the vacuum chamber 16. To this effect a transverse axle generally designated by the reference numeral 90 runs generally parallel with the vacuum chamber 16. The wheels 96 are secured for rotation between a pair of rearwardly projecting struts 98, which generally perpendicularly mount axle 90. A reinforcement rib 99 affixed to the rear surface 19 of the vacuum chamber 16 extends from one strut 98 to the other. The wheels 96 are rotatably secured between struts 98 and journalled for rotation on the axle 90.

Operation of my tool 10 is best understood by reference to FIGS. 8 and 9. After tool 10 is deployed on the carpet 12 to be treated, weights 28 and 29 are deposited within the weight box 32 to further pressure the heavy roller 60. An operator 11 may then lift gently upwardly on handle, 42, transferring the weight of the tool 10 to the roller assembly 22. As he draws the tool 10 toward him, in the direction generally indicated by arrow 39 (FIG. 9) a puddle of water 103 will develop adjacent suction inlet 50 at the bottom of the vacuum chamber 16. This water will be sucked into chamber 16 and exited through handle 42 and connecting vacuum hose 54. The opposite side of the operation cycle is illustrated in FIG. 8, wherein tool 10 is moved in the direction of arrow 38. In this case slight pressure by the operator 11 must be exerted downwardly upon handle 42, transferring the weight of the apparatus to the wheel assemblies 18.

The wheels 96 thus enable the apparatus to be moved for a return stroke; or in other words, a repeat of the process illustrated in FIG. 9. When sufficient cycles of this nature are performed upon the carpet 12 and its pad 14, subsequent vacuum extraction cleaning will be effective. In fact, the weight of the assembly 10 is sufficient to remove enough water that complete drying of the carpet will be accomplished by properly ventilating the carpet 12, pad 14, rug or dwelling. Application of a mildewcide will prevent the subsequent growth of mildew or fungus in the relatively high humidity environment fostered by the evaporation of remaining moisture.

The relatively large roller wheels 96 preferably have a diameter of approximately five inches. The roller 60 preferably has a diameter of approximately three and one-half inches. The ratio of the diameter of the wheels to the diameter of the roller 60 is preferably between 10:6 and 10:8, with a ratio of 10:7 being the best I have experimented with so far for stability. This ratio range eases operation of my tool and promotes efficiency.

Returning to FIGS. 8 and 9, the mechanical advantage experienced by the operator 11 is generated by the various operational centers of mass and centers of rotation. In FIG. 9 the center of mass of the weight box 32 has been designated by line 110. The center of rotation of the cylindrical roller is designated by the reference numeral 112. The center of the vacuum chamber 16 is designated by the line 114. The center of rotation of the wheels 96 is designated by a reference number 116. It is thus apparent that the center of mass 110 of weight box 32 is spaced apart from the center 114 of vacuum chamber 16 by a distance 118. The latter distance corresponds to the distance 120 between the center of rotation 112 of roller 60 and line 114. Similarly, the center of rotation 116 of the wheels 96 is spaced apart from line 114 by distance 122. Handle 42 is coupled to the vacuum chamber 16 at an angle of approximately Forty degrees, identified by the reference numeral 125. The center of rotation 112 of roller 60, and the center of mass 110 of the weight box 32 are spaced-apart from the center of rotation of 116 wheels 96 by a distance of 128 equal to the sum of distances 120 and 122.

With this configuration the tool 10 will assume a stable position illustrated in FIG. 9 when not grasped by the operator 11 or when deployed in the water capturing position as the entire weight is transferred to the roller assembly 22. In this case the force necessary to move the tool 10 in the direction indicated by arrow 39 is equal to the weight of the tool 10 multiplied times distance 120, and divided by the approximate length of the handle times the cosign of angle 125, according to well known mechanical engineering equations. In this case, the force required to move the apparatus is approximately Twenty percent the weight of the tool 10.

However, in FIG. 8, when the tool is moved through the return stroke in the direction of the arrow 38, all of the weight of the tool 10 is disposed on the wheels 18. The device is essentially balanced in this fashion, and the force necessary to push the loaded tool in the direction of arrow 38 has been measured at around ten percent of the total weight of the tool.

The reduced pushing force results from moments developed across distances 120 or 122 that tend to balance the apparatus. When the handle 42 is pushed downwardly to the position illustrated in FIG. 8, the center of mass of the apparatus 10 moves rearwardly, such that the weight is primarily transferred to wheels 18, and control force required for the handle 42 is reduced.

Obviously, once the carpet 12 and its pad 14 are treated with the present invention, and subjected to conventional subsequent cleaning techniques, the carpet need not be replaced. Thus, substantial savings to the owner are realized.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A liquid removal tool for deflooding carpets, carpet pads or rugs, said tool comprising:

a front and a rear;

a rigid, hollow, vacuum chamber disposed between said front and said rear and comprising a front face, a rear face, a pair of spaced apart sides, and a lower, generally rectangular open suction inlet extending between said sides for suctioning liquids to be removed;

wheel means rigidly mounted to said vacuum chamber adjacent said rear for facilitating movement of said tool, said wheel means comprising a given diameter;

cylindrical roller means normally supporting said tool and rigidly mounted to said vacuum chamber adjacent said front for liberating liquid by contacting and compressing said carpet, carpet pad or rug whereby to establish a pool of liquid adjacent said open suction inlet for subsequent intake by said vacuum chamber, said vacuum chamber being in fluid flow communication with said pool of liquid, said roller means comprising a given diameter;

an elongated, rigid tubular handle angularly coupled at the rear of said machine to said vacuum chamber in fluid flow communication with said suction inlet, said handle adapted at its remote end to be coupled to a conventional vacuum source whereby to establish vacuum chamber suction, said handle comprising a translucent portion providing for visual observation of liquid as it is drawn through said handle;

weight box means rigidly secured to said vacuum chamber at the front of said tool above said roller means for containing a plurality of weights for variably weighting said tool, wherein said weight box means establishes a center of mass horizontally spaced-apart from said vacuum chamber at the front of said tool and vertically spaced above said roller means enabling the user of said tool to easily transfer weight to the roller means by lifting upwardly on the handle to pivot the wheel means out of contact with the carpet, carpet pad or rug being deflooded; and, wherein said wheel means are offset from said suction inlet by strut means projecting rearwardly from said tool and said wheel means is spaced above said carpet, carpet pad or rug so that when the weight of said weight box means is transferred to said roller means by lifting upwardly on said handle, said wheel means is displaced out of contact with said carpet, carpet pad or rug and the weight of the tool is concentrated upon said roller means and said suction inlet, and when said handle is pressed downwardly, said roller means is pivoted out of contact with said carpet, carpet pad or rug being deflooded.

2. The tool as defined in claim 1 wherein the ratio between the diameter of said wheel means to the diameter of said roller means is between 10:6 and 10:8.

3. A deflooding tool for removing water from inside floor coverings such as carpets and rugs, said tool comprising: prism a hollow vacuum chamber comprising a top, a bottom, and a front and back side, said back side having an open, circular outlet, and said bottom comprising an open, rectangular suction inlet for intaking said water;

wheel means comprising a given diameter and rigidly mounted to said back side of said vacuum chamber by strut means projecting rearwardly from said vacuum chamber, said wheel means facilitating movement of said tool, said wheel means vertically offset above said suction inlet;

a weight box comprising a back plate, two sides, a floor and a front plate, said back plate being of rectangular shape and rigidly secured to said front side of said vacuum chamber for weighting said tool and compressing said roller against said floor covering, the center of mass of said weight box being horizontally and vertically displaced from said vacuum chamber, said center of mass of said weight box being substantially vertically aligned with a center of rotation of said roller means to stabilize said tool;

removable weights contained within said weight box;

a cylindrical roller comprising a given diameter, said wheel means diameter being greater than the diameter of said roller, and wherein said roller extends transversely generally between said sides in front of said vacuum chamber, said roller liberating water by compressing said floor covering to establish a pool of water immediately adjacent said open suction inlet for subsequent intake by said vacuum chamber, said vacuum chamber being in fluid flow communication with said pool of water;

an elongated, rigid tubular handle coupled to said vacuum chamber at said circular outlet and in fluid flow communication with said suction inlet, said handle comprising a remote end adapted to be coupled to a conventional vacuum source to establish vacuum chamber suction and a translucent portion providing for visual observation of water as recovered water and air is drawn through said handle, said handle being angularly coupled to said vacuum chamber whereby a mechanical advantage established when said tool is either pushed or pulled by a human operator; and, whereby when said handle is released by an operator, the tool assumes a stable position wherein the weight of said tool is concentrated upon said roller.

4. A deflooding tool for removing liquids from floor coverings, said tool comprising:

a rigid, hollow, vacuum chamber comprising a front, a rear and a lower, open suction inlet for intaking said liquids to be removed;

wheels rigidly mounted to the rear of said vacuum chamber, said wheels offset vertically and horizontally from said suction inlet, each wheel comprising a given diameter;

cylindrical roller means rigidly mounted to said vacuum chamber at the front thereof for compressing liquid from said floor covering and establishing a pool of liquid adjacent said suction region for intake by said chamber, said vacuum chamber being in fluid flow communication with said pool of liquid, and said roller means comprising a given diameter wherein the ratio between the diameter of said wheels to the diameter of said roller means is between 10:6 and 10:8;

said vacuum chamber dimensioned longer than the roller to establish a concentration gradient for effectively removing said liquid;

an elongated, rigid tubular handle angularly coupled to said vacuum chamber in fluid flow communication with the suction region, said handle establishing a mechanical advantage when said tool is either pushed or pulled by an operator, said handle adapted at its remote end to be coupled to a vacuum source to establish vacuum chamber suction;

said handle comprising a translucent portion providing for visual observation of extracted liquid as it is drawn through said handle, said translucent portion being reinforced by a pair of elongated members adjacent said translucent portion generally parallel to said handle;

strut means projecting rearwardly from said vacuum chamber for mounting said wheel means such that, when said handle is manually depressed the weight of the tool is transferred to said wheel means; and, weight box means rigidly secured to the front of said vacuum chamber, the center of mass of said weight box means horizontally spaced-apart from said vacuum chamber and vertically spaced-apart and substantially vertically aligned with a center of rotation of said roller means, whereby, when said handle is released, weight is transferred to and concentrated upon said roller means.

* * * * *